US006920978B2

(12) United States Patent
Fischer et al.

(10) Patent No.: US 6,920,978 B2
(45) Date of Patent: Jul. 26, 2005

(54) TRAY FOR TRANSPORTING MULTIPLE TYPES OF FLAT GRAPHIC ARTICLES

(75) Inventors: Virginia K. Fischer, Forest Lake, MN (US); Donald C. Lindemann, New Richmond, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 38 days.

(21) Appl. No.: 10/062,611

(22) Filed: Jan. 31, 2002

(65) Prior Publication Data

US 2003/0141215 A1 Jul. 31, 2003

(51) Int. Cl.[7] ..... B65D 85/68
(52) U.S. Cl. ..... 206/335; 206/499; 206/564
(58) Field of Search ..... 206/561, 564, 206/523, 503, 509, 363, 438, 570, 449, 454–456, 499, 335; 53/467, 473, 474

(56) References Cited

U.S. PATENT DOCUMENTS

| | | | | | |
|---|---|---|---|---|---|
| 2,624,582 | A | * | 1/1953 | Molinar | 206/449 |
| 3,802,555 | A | * | 4/1974 | Grasty et al. | 206/564 |
| 3,802,592 | A | | 4/1974 | Wheaton, III | |
| 3,877,575 | A | | 4/1975 | Cracco et al. | |
| 4,153,160 | A | * | 5/1979 | Leigh | 206/564 |
| 4,266,669 | A | * | 5/1981 | Watson | 206/564 |
| 5,031,775 | A | * | 7/1991 | Kane | 206/438 |
| 5,275,281 | A | * | 1/1994 | Ebeling | 206/564 |
| 5,292,001 | A | | 3/1994 | Langenbeck et al. | |
| 5,311,990 | A | * | 5/1994 | Kalinski | 206/570 |
| 5,318,543 | A | * | 6/1994 | Ross et al. | 206/571 |
| 5,462,167 | A | * | 10/1995 | Polinski et al. | 206/449 |
| 5,642,813 | A | | 7/1997 | Nyseth | |
| 5,829,229 | A | | 11/1998 | Hyatt et al. | |
| 5,947,284 | A | * | 9/1999 | Foster | 206/564 |
| 6,068,121 | A | * | 5/2000 | McGlinch | 206/438 |
| 6,109,445 | A | | 8/2000 | Beyer | |
| 6,216,885 | B1 | * | 4/2001 | Guillaume | 206/564 |
| 6,332,769 | B1 | | 12/2001 | Bashor et al. | |
| 6,474,475 | B1 | * | 11/2002 | Bjork | 206/564 |
| 6,533,116 | B1 | * | 3/2003 | Riley | 206/363 |

* cited by examiner

*Primary Examiner*—Luan K. Bui

(57) ABSTRACT

A tray for transporting flat graphic articles. The tray comprises a top surface and two or more cavities that intersect each other at one or more locations. An opening is formed in the top surface and defines an entrance to the cavity. Each cavity is structured to receive therein, through its opening, a plurality of a flat graphic article stacked one on top of the other so as to form a stack. Each cavity can receive therein a flat graphic article that is different than the flat graphic article that can be received into the other cavity or cavities. A method that comprises using one or more such trays to transport flat graphic articles. The method can include providing two or more of the same tray and using each tray to transport a plurality of a different flat graphic article.

28 Claims, 4 Drawing Sheets

TRAY FOR TRANSPORTING MULTIPLE TYPES OF FLAT GRAPHIC ARTICLES

FIELD OF THE INVENTION

The present invention relates to packaging for transporting articles, more particularly, to packaging for transporting flat graphic articles that are structured to be attached to a surface and, even more particularly, to a reusable tray for transporting a variety of flat graphic articles, a plurality of one type of flat graphic article at a time. The present invention also relates to a method of using such a tray and a method of using flat graphic articles.

BACKGROUND OF THE INVENTION

Various flat graphic articles have been used on vehicles such as, for example, automobiles to provide aesthetic and/or protective features. One such flat graphic article is a paint film article that is used to replace the application of conventional liquid paint on selected portions of the vehicle. A typical paint film article is a polymeric film that is backed with some kind of adhesive (e.g., a heat activated or pressure sensitive adhesive) where the film is flat and contains a pigment or some other type of coloring system. A release liner is typically used to protect the adhesive until the article is about to be applied. Paint film articles have been used to replace conventional liquid paint on, for example, the pillar and sash portions of a car door window frame. In this type of application, the paint film article is typically a one-piece construction having two sections. Each section is longer than it is wide and much wider than it is thick. The two sections come together at a common end. One section is generally straight along its length to match the pillar and the other is generally curved along its length to match the sash. When prepared for shipment to a customer, such paint film articles are usually stacked one on top of the other and bound together, such as with shrink wrap, adhesive tape, etc. The stack is then placed in a box. When the shipment is received, the stack is typically unbound and the paint film articles are applied one at a time.

Because of their construction, such flat graphic articles are susceptible to being damaged during shipping and handling, even when they are in the form of a bound stack. In addition, after the stack is received, the subsequent handling and use of such flat graphic articles can be awkward and inefficient.

Therefore, there is a need for a way to protect such flat graphic articles from damage during shipping and handling, as well as making it easier and more efficient to handle and use such flat graphic articles after they have been received.

SUMMARY OF THE INVENTION

This need can be satisfied by providing a package for flat graphic articles according to the present invention. As used herein, the term "flat graphic article" refers to an article that comprises a graphic substrate that is longer than it is wide and wider than it is thick. The graphic substrate can be an adhesive-backed substrate, with the adhesive being of any suitable kind such as, for example, a pressure sensitive or heat activated adhesive. The substrate can provide, for example, decorative and/or protective characteristics to the surface to which it is applied. When the graphic substrate is backed with an adhesive, it can be desirable for the flat graphic article to further comprise a release liner that is readily releasable from and bonded to, so as to protect, the adhesive on the graphic substrate. The graphic substrate can comprise, for example, a generally flat sheet having a top surface with a decorative or otherwise graphic appearance and a back surface on which an adhesive may be adhered. The flat graphic article is structured such that a plurality of the flat graphic article can be positioned one on top of the other in the form of a stack of the articles.

In one aspect of the present invention, a tray is provided for transporting flat graphic articles. The tray comprises a top surface and two or more cavities that intersect each other at one or more locations. One cavity intersects another cavity when the one cavity at least extends into the other cavity or, preferably, when the one cavity passes through and extends beyond (i.e., crosses) the other cavity. An opening is formed in the top surface and defines an entrance to the cavity. Each cavity is structured to receive therein, through its opening, a plurality of a flat graphic article stacked one on top of the other so as to form a stack. Each cavity can receive therein a flat graphic article that is different than the flat graphic article that can be received into the other cavity or cavities. By structuring each cavity so as to receive a different flat graphic article, the tray becomes more versatile and universal in that the same tray can be used to transport a variety of different flat graphic articles. By supplying the various flat graphic articles using the same tray, the user of the articles only needs to keep track of one tray design. Thus, the trays of the present invention can be particularly suited for automated assembly operations.

Each cavity is preferably in the form of a channel. Each channel has a depth and an opening. The opening is formed in the top surface and defines an entrance to the channel, with the opening being longer than it is wide. Each channel is structured to receive therein, through its opening, a plurality of a flat graphic article stacked one on top of the other so as to form a stack. At least one of the channels intersects at least one of the other channels at one or more locations along its length. One channel intersects another channel when the one channel at least extends into the other channel or, preferably, when the one channel passes through and extends beyond (i.e., crosses) the other channel. The channels are structured such that each channel can receive therein a flat graphic article that is different than the flat graphic article that can be received into the other channel(s). By structuring each channel so as to receive a different flat graphic article, the tray becomes more versatile and universal in that the same tray can be used to transport a variety of different flat graphic articles. By supplying the various flat graphic articles using the same tray, the user of the articles only needs to keep track of one tray design. Thus, the trays of the present invention can be particularly suited for automated assembly operations.

When two flat graphic articles that are mirror images of each other, or are otherwise very similar in dimensions, are to be shipped to a customer, or otherwise transported, the two flat graphic articles can be stacked in the same channel of a tray. Even though a single tray could be used to so transport both of these articles, it is often desirable to use a separate tray (i.e., two of the same tray) to transport such different flat graphic articles. For example, having the two articles supplied in separate trays can facilitate the concurrent or consecutive application of the two articles by an end user.

In one embodiment, each channel has two or more legs or lengths. It can be desirable for one leg to be generally straight along its length and another leg to be generally curved along it length. The two legs come together at a common end such that the legs form an angle therebetween. It can be desirable for this angle to be about 90° or less. One or more of the legs of one of the channels intersects one or more of the legs of another of the channels.

It can be desirable for one or more of the legs of one of the channels to intersect two legs of another of the channels. It can also be desirable for one or more of the legs of each of the channels to intersect two legs of another of the channels.

The tray according to the present invention can include three or more channels. With such a tray, it can be desirable for each of the two legs of one of the channels to intersect one or more of the legs from each of two other of the channels. With such a tray, it can also be desirable for each of the two legs of two of the channels to intersect one or more of the legs from each of two other of the channels.

It is desirable for at least one, and preferably all, of the cavities to include a side wall that has at least one recessed portion that defines an access space. Each access space is positioned along the side wall and dimensioned to facilitate the positioning of a corresponding flat graphic article in and out of the cavity.

It is desirable for each of the channels to include opposing side walls with at least one of the side walls including one or more access spaces.

It can be desirable for the peripheral edge of the top surface to include at least one portion that defines a hand hold that is positioned and sized to facilitate the positioning of the tray in and out of a container.

It is desirable for one or more of the channels to include a plurality of vertical positioning ribs at spaced locations along the length of the channel(s). Each rib is located on at least one, or preferably both, of the side walls. These ribs help to prevent the stack of the flat graphic article from moving from side within the channel. Some flat graphic articles are susceptible to being damaged if allowed to shift from side-to-side during transport or handling of the tray.

The tray according to the present invention is preferably structured so that at least the same trays can be stacked one on top of the other.

In another aspect of the present invention, a method is provided for using a tray as described above. The method comprises using one or more such trays to transport flat graphic articles. The method can include providing two or more of the same tray and using each tray to transport a plurality of a different flat graphic article.

In an additional aspect of the present invention, a method is provided for using a tray to transport a plurality of at least two different flat graphic articles. The method comprises providing two trays according to the present invention, with each tray having the same cavities; depositing flat graphic articles into one of the cavities of one tray; depositing different flat graphic articles in a different one of the cavities of the other tray; transporting the trays to a location were the flat graphic articles are to be used (e.g., applied); removing and using the flat graphic articles from the one tray (e.g., by applying them onto a surface); removing and using the different flat graphic articles from the other tray (e.g., by applying them onto a different surface); and returning the trays in an at least partially empty state for subsequent reuse.

It can be desirable for a plurality of the trays to be transported, for example, by disposing the trays in a container and shipping the container to the desired location. Additionally, or alternatively, the method can include disposing the tray on a cart or a suspended rail system for subsequent transporting to a location at which the articles are to be used. It can be desirable for the removing and using of the flat graphic articles and the removing and using of the different flat graphic articles to at least generally occur consecutively or simultaneously.

After the trays have been returned, it is desirable for the method to include re-depositing flat graphic articles into one of the cavities of the one tray and re-depositing different flat graphic articles in a different one of the cavities of the other tray.

DETAILED DESCRIPTION OF SOME EMBODIMENTS

Figure 1:
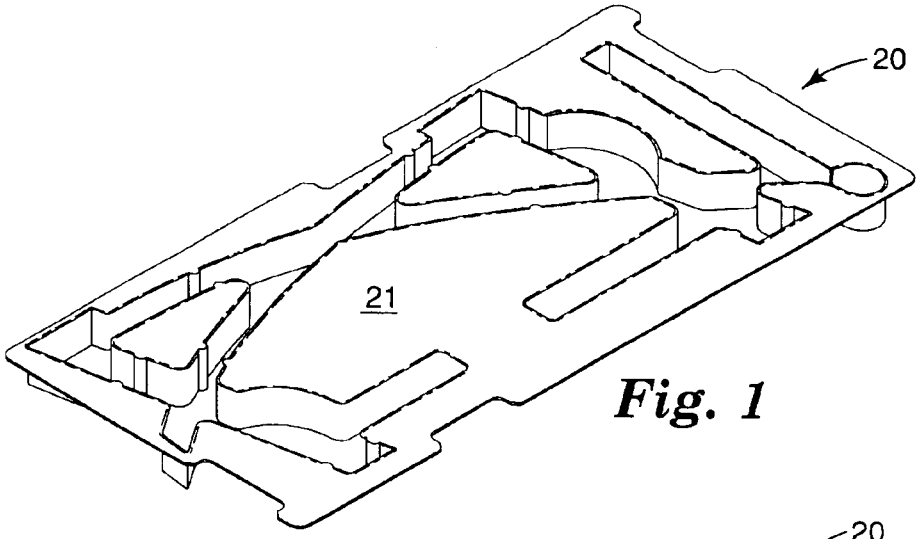
FIG. 1 is a perspective view of one embodiment of a tray according to the present invention.
Figure 2:
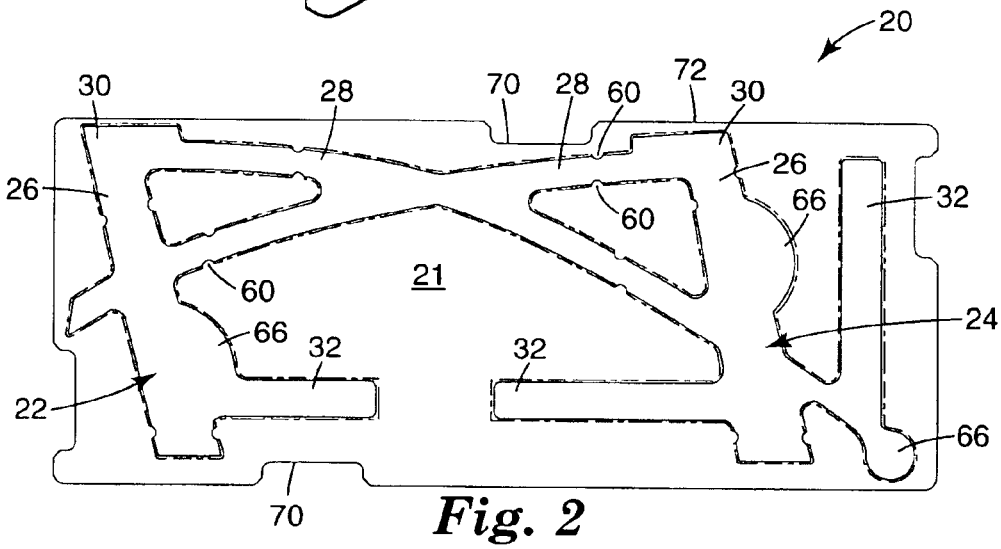
FIG. 2 is a top plan view of the embodiment of FIG. 1.
Figure 3:
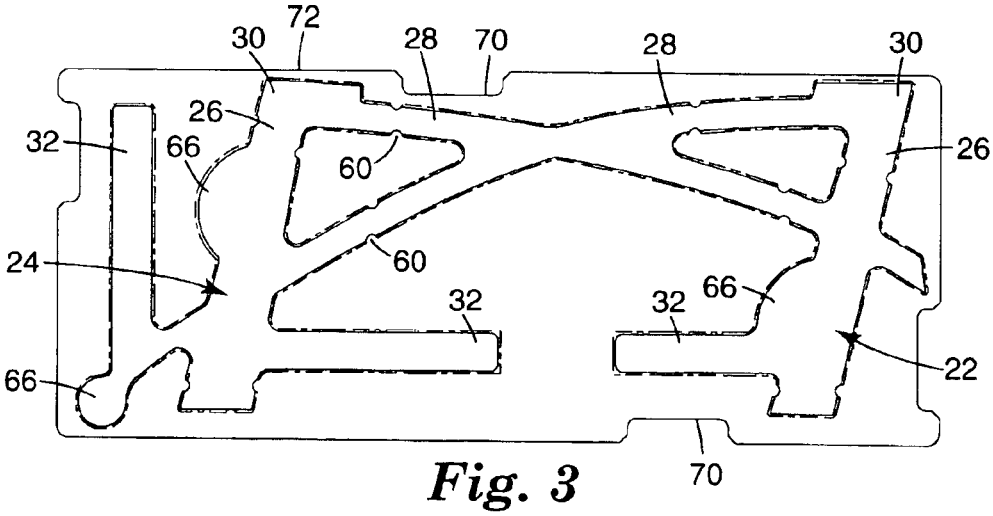
FIG. 3 is a bottom plan view of the embodiment of FIG. 1.
Figure 4:
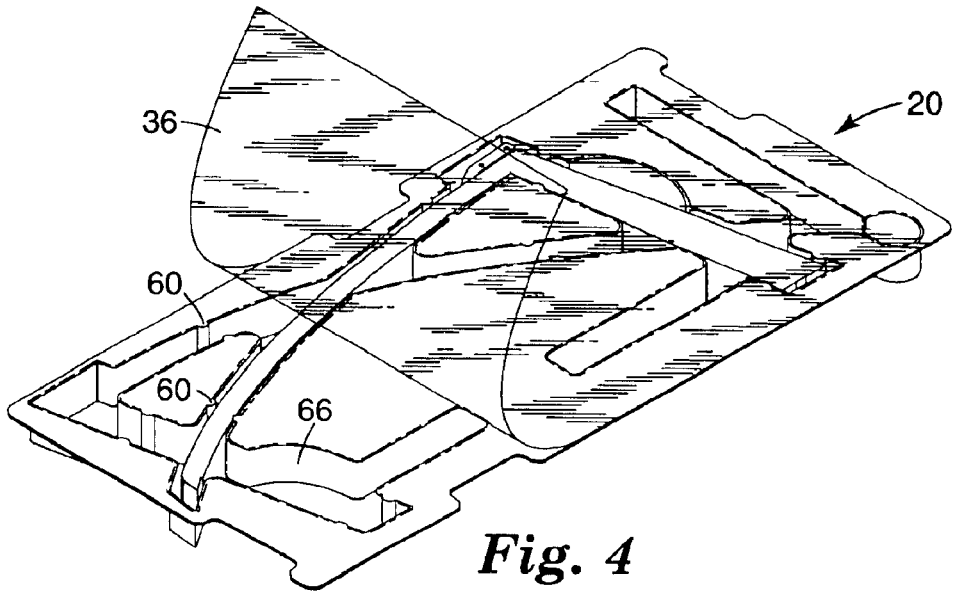
FIG. 4 is a perspective view of the tray of FIG. 1 with a protective cover partially removed and a stack of an exemplary flat graphic article disposed in one of the channels.
Figure 5:
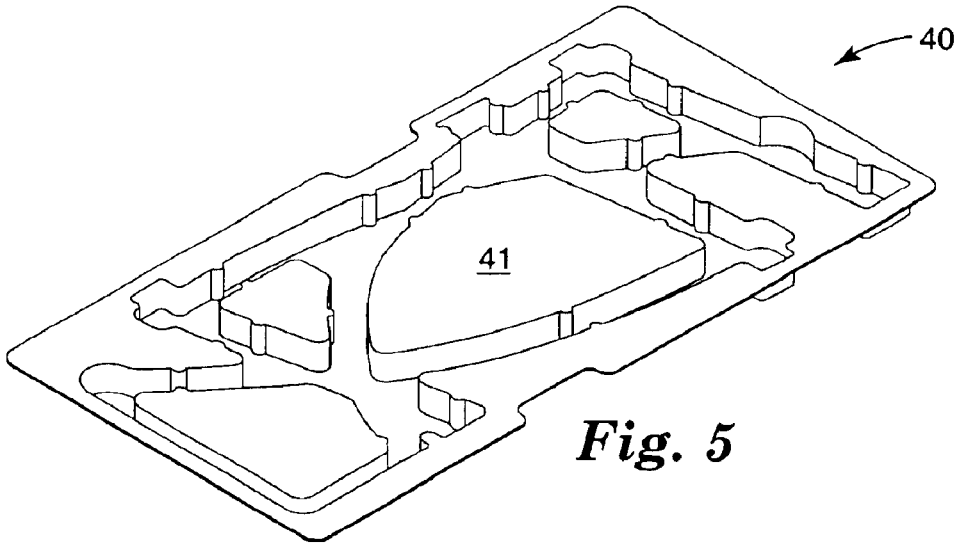
FIG. 5 is a perspective view of another embodiment of a tray according to the present invention.
Figure 6:
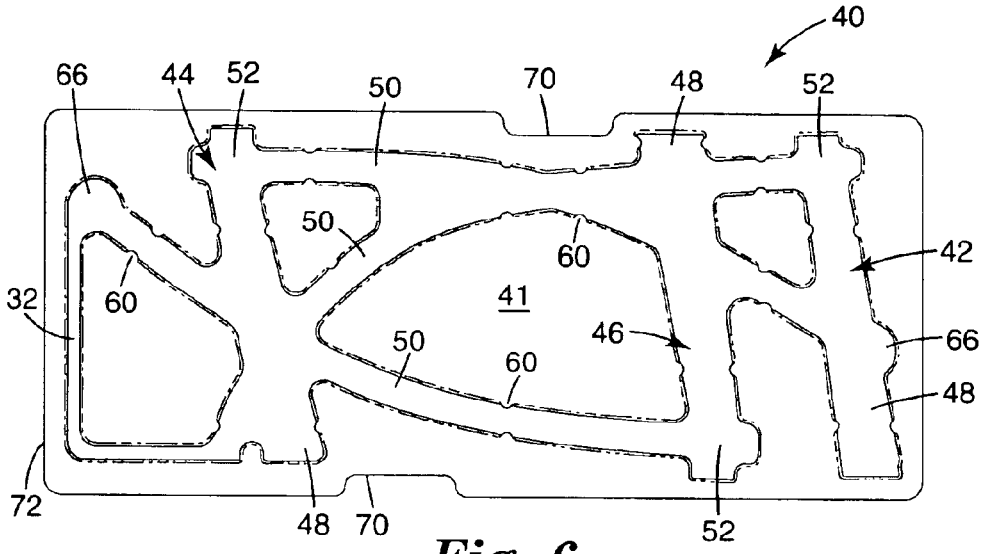
FIG. 6 is a top plan view of the embodiment of FIG. 5.
Figure 7:
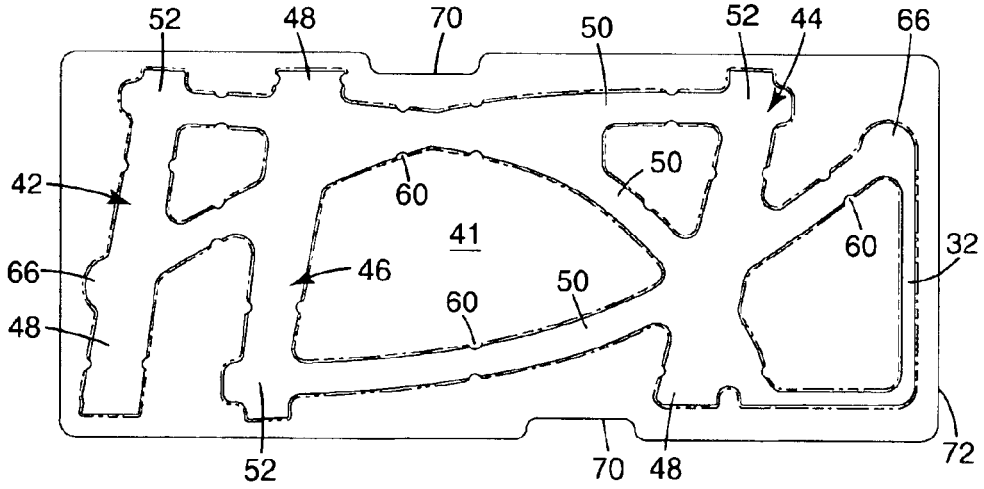
FIG. 7 is a bottom plan view of the embodiment of FIG. 5.
Figure 8:
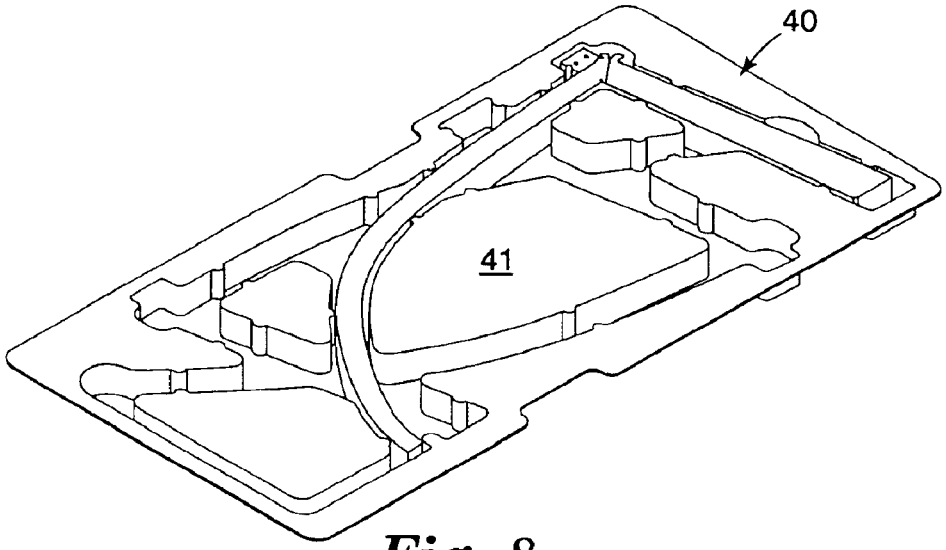
FIG. 8 is a perspective view of the embodiment of FIG. 5 with a stack of another exemplary flat graphic article disposed in one of the channels.

Although the present invention is herein described in terms of specific embodiments, it will be readily apparent to those skilled in this art that various modifications, re-arrangements, and substitutions can be made without departing from the spirit of the invention. The scope of the present invention is thus only limited by the claims appended hereto.

According to the present invention, a tray is provided for transporting flat graphic articles. The tray can be made using conventional materials and manufacturing techniques. For example, acceptable trays have been made by thermoforming ABS sheets over a male mold element. The tray comprises a top surface and two or more cavities that intersect each other at one or more locations. One cavity intersects another cavity when the one cavity at least extends into the other cavity or, preferably, when the one cavity passes through and extends beyond (i.e., crosses) the other cavity. Each cavity has a depth and an opening structured to accommodate the number and dimensions of the flat graphic articles to be disposed in the cavity. An opening is formed in the top surface and defines an entrance to the cavity. Each cavity is structured to receive therein, through its opening, a plurality of a flat graphic article stacked one on top of the other so as to form a stack. Each cavity can receive therein a stack of a flat graphic article that is different than the flat graphic article that can be received into the other cavity or cavities. By structuring each cavity so as to receive a different flat graphic article, the tray becomes more versatile and universal in that the same tray can be used to transport a variety of different flat graphic articles. By supplying the various flat graphic articles using the same tray, the user of the articles only needs to keep track of one tray design. Thus, the trays of the present invention can be particularly suited for automated assembly operations.

Each cavity is preferably in the form of an open-faced channel. The opening is formed in the top surface and defines an entrance to the channel, with the opening being longer than it is wide. Each channel is structured to receive therein, through its opening, a plurality of a flat graphic article stacked one on top of the other so as to form a stack. At least one of the channels intersects at least one of the other channels at one or more locations along its length. One channel intersects another channel when the one channel at least extends into the other channel or, preferably, when the one channel passes through and extends beyond (i.e., crosses) the other channel. The channels are structured such that each channel can receive therein a stack of a flat graphic article that is different than the flat graphic article that can be received into the other channel(s). By structuring each channel so as to receive a different flat graphic article, the tray becomes more versatile and universal in that the same tray can be used to transport a variety of different flat graphic articles. By supplying the various flat graphic articles using the same tray, the user of the articles only needs to keep track of one tray design. Thus, the trays of the present invention can be particularly suited for automated assembly operations.

When two flat graphic articles that are mirror images of each other, or are otherwise very similar in dimensions, are to be shipped to a customer, or otherwise transported, the two flat graphic articles can be stacked in the same channel of a tray. Even though a single tray could be used to so transport both of these articles, it is often desirable to use a separate tray (i.e., two of the same tray) to transport such different flat graphic articles. For example, having the two articles supplied in separate trays can facilitate the concurrent or consecutive application of the two articles by an end user.

In one embodiment, each channel has two or more legs or lengths. It can be desirable for one leg to be generally straight along its length and another leg to be generally curved along it length. The two legs come together at a common end such that the legs form an angle therebetween. It can be desirable for this angle to be about 90° or less. One or more of the legs of one of the channels intersects one or more of the legs of another of the channels.

It can be desirable for one or more of the legs of one of the channels to intersect two legs of another of the channels. It can also be desirable for one or more of the legs of each of the channels to intersect two legs of another of the channels.

The tray according to the present invention can include three or more channels. With such a tray, it can be desirable for each of the two legs of one of the channels to intersect one or more of the legs from each of two other of the channels. With such a tray, it can also be desirable for each of the two legs of two of the channels to intersect one or more of the legs from each of two other of the channels.

Referring to FIGS. 1–4, one tray 20 according to the present invention includes a top surface 21, a first channel 22 and a second channel 24. Each of the first channel 22 and the second channel 24 has a first or straight leg 26 and a second or curved leg 28 that come together at a common end 30. The curved leg 28 of the first channel 22 crosses the curved and straight legs 28,26 of the second channel 24. Likewise, the curved leg 28 of the second channel 24 crosses the curved and straight legs 28,26 of the first channel 22. In this way, the dimensions of the top surface 21 of the tray 20 can be minimized while retaining the versatility of the tray 20 in being able to transport different flat graphic articles. The tray 20 includes structural support channels 32 to provide additional rigidity and structural strength to the tray 20 and, thereby, additional support for the flat graphic articles transported in the tray 20. The number, size and shape of such structural support channels can vary depending on the degree and location of support deemed necessary.

While it may not be necessary, it is often preferred to cover a tray, of the present invention, containing flat graphic articles in order to prevent contamination of the articles therein. Suitable covers can include a removable lid, a hinged lid that can be removably or permanently attached to the tray, by laying a film or paper on top of the tray, or preferably, by sealing the tray with a high moisture barrier film (e.g., a clear polymeric film 36 such as that shown in FIG. 4) that is adhered or otherwise bonded to the tray. Such a sealing film 36 can be a film that inherently clings to the material used to form the tray, but it is preferably adhesively bonded to the tray using, for example, a pressure sensitive adhesive or hot melt adhesive.

Figure 9:
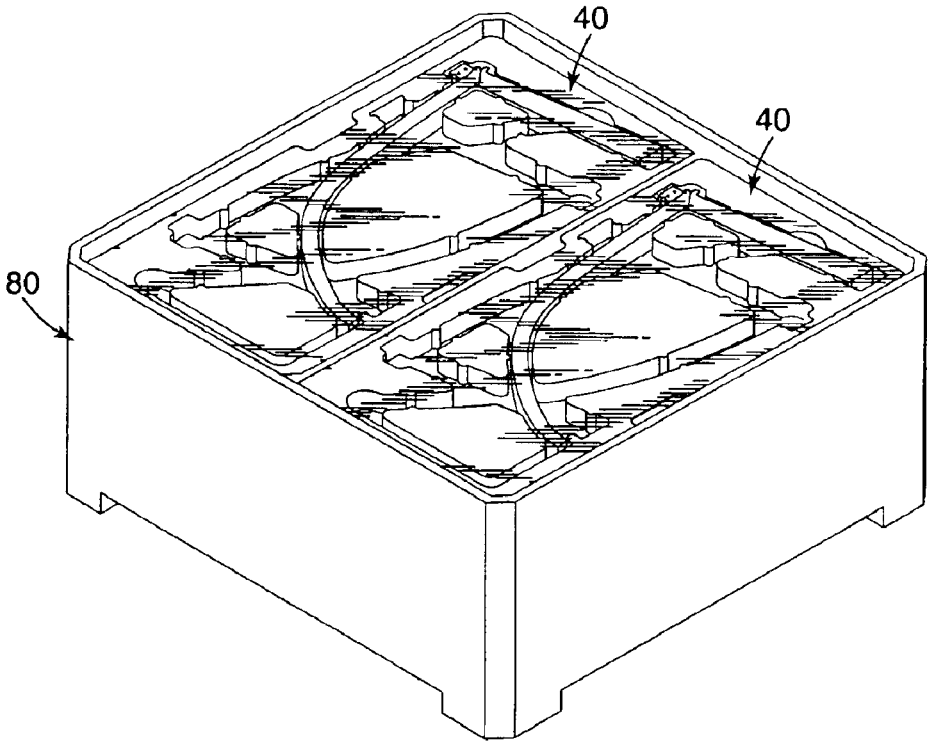
FIG. 9 is a perspective view of a shipping container containing a plurality of the tray of FIG. 5. with a protective cover over each tray and a stack of an additional exemplary flat graphic article disposed in one of the channels of each tray.

Referring to FIGS. 5–8, another tray 40 according to the present invention includes a top surface 41, a first channel 42, a second channel 44 and a third channel 46. Each of the first channel 42, second channel 44 and third channel 46 has a first or straight leg 48 and a second or curved leg 50 that come together at a common end 52. The curved leg 50 of the first channel 42 crosses the curved and straight legs 50,48 of the second channel 44 and of the third channel 46. The straight leg 48 of the first channel 42 also crosses the curved leg 50 of the second channel 44. In addition, the curved leg 50 of the second channel 44 crosses the curved and straight legs 50,48 of the first channel 42 and the straight leg 48 of the third channel 46. The straight leg 48 of the second channel 44 crosses the curved leg 50 of the first channel 42 and of the third channel 46. Furthermore, the curved leg 50 of the third channel 46 crosses the curved leg 50 of the first channel 42 and the straight leg 48 of the second channel 44. The straight leg 48 of the third channel 46 crosses the curved leg 50 of the first channel 42 and of the second channel 44. In this way, the dimensions of the top surface 41 of this tray 40 can also be minimized while retaining the versatility of the tray in being able to transport an even greater variety of flat graphic articles. The tray 40 also includes a structural support channel 32 that provides additional rigidity and structural strength to the tray 40 and, thereby, additional support for the flat graphic articles transported in the tray 40. Trays according to the present invention, preferably, include a plurality of vertical positioning ribs or pillars 60 at spaced locations on one, or preferably both, of the side walls and along the length of each of the channels. These ribs 60 help to keep the flat graphic article positioned in the corresponding channel, for example, so as not to shift around during shipment of the tray. Some flat graphic articles are susceptible to being damaged if allowed to shift from side-to-side during transport or handling of the tray. The present trays also, preferably, include a number of access spaces 66 located along one or both of the side walls of each channel. The access space 66 can be formed by a recessed portion of the side wall. These access spaces 66 are positioned and dimensioned to facilitate the insertion and/or removal, by hand or selected fingers, of the flat graphic articles to be disposed in the tray channels. In addition, the present trays, preferably, include two or more hand holds 70 at spaced locations on the peripheral edge 72 of the top surface of the tray. A hand hold 70 can be a depression in the peripheral edge 72 of the top surface that is positioned and sized to facilitate the hand removal of the tray from a shipping box 80 or other container such as that shown in FIG. 9. Such hand holds 70 can be formed by, for example, cutting out an adequately sized and positioned portion of the material used to form the tray along its peripheral edge 72. The trays according to the present invention are preferably structured so that at least the same trays can be stacked one on top of the other (see FIG. 9).

Shipping containers can be of any type such as, for example, a corrugated cardboard box, a plastic corrugated box, a formed box, e.g., injection molded or thermoformed, and the like. Preferably, the container is plastic and can be injection molded or thermoformed, or assembled using corrugated plastic panels.

The present invention is particularly suited to transporting flat graphic articles to an automobile assembly line which will be used to illustrate the invention. In this illustration, decorative and/or protective films are die-cut to fit over the front door sash and door pillar, and the rear door sash and door pillar on each side of an automobile. In all, four different flat graphic articles are required for this assembly. A single tray can be designed, such as tray 40, to hold all four of the flat graphic articles but preferably, a multiple number of a single flat graphic article is stacked in the tray at any given time, e.g., one of the cavities is filled only with flat graphic articles for the front door sash and pillar. This advantageously removes the possibility of an operator removing the wrong flat graphic article, having to replace the flat graphic article in the container without damaging it, and then pulling out the right flat graphic article, which slows down the operation and introduces the possibility of damaging the flat graphic article. After the trays are filled with a flat graphic article, they are packed into pallet containers, which are preferably made from recyclable materials, and then sent to the vehicle manufacturer. The trays are then removed from the pallet container and positioned along an assembly line so that an operator can conveniently remove a flat graphic article from the tray. As a vehicle moves down the assembly line, a first operator pulls a first flat graphic article from a first tray containing flat graphic articles for, e.g., the right front door sash and applies it to the vehicle. A second operator removes a second flat graphic article from a second tray containing the right rear door sash and applies it. Likewise, operators on the left side of the vehicle can remove flat graphic articles for the left front door sash and left rear door sash from third and fourth trays containing them and apply them. The operators can work sequentially or simultaneously on applying the film. When all of the flat graphic articles are used, the trays are returned to the pallet container which in turn is returned to the supplier. In the practice of the method, a single tray design is preferably used to avoid excess inventory and having to track different tray configurations for different flat graphic articles.

In the present method, a single basic tray design can be used to accommodate a plurality of different flat graphic articles to be used by a user such as, for example, by an original equipment manufacturer (OEM) for a given vehicle. Thus, the supplier of the flat graphic articles and the user of those articles only needs to keep track of one tray and one packaging system for the plurality of flat graphic articles used. Preferably, the tray is designed to accommodate all of the flat graphic articles to be used on a given vehicle. One advantage that can be attained using trays with intersecting cavities, according to the present invention, is that the present trays can be designed to minimize the size of the packaging needed to ship a variety of flat graphic articles.

In the assembly line manufacturer of vehicles, especially in automobile manufacturing, the OEM requires that the assembly work to be performed at a given assembly line station be performed within a pre-established time period or tact time. This time period is typically about 60 seconds, but it can be more or less depending on the operation being performed at the station. Flat graphic articles, especially mirror image articles, are typically applied simultaneously on both sides of an automobile. The present method helps to facilitate this process by making it easier, and therefore reducing the time it takes, to apply such flat graphic articles to the automobile.

From the above disclosure of the general principles of the present invention and the preceding detailed description, those skilled in this art will readily comprehend the various modifications, re-arrangements and substitutions to which the present invention is susceptible. Therefore, the scope of the invention should be limited only by the following claims and equivalents thereof.

What is claimed is:

1. A combination comprising a tray and a plurality of flat graphic articles, said tray comprising a top surface, and a cavity in the form of a channel longer than it is wide, said channel having at least two legs, with said legs being connected together at a common end, said cavity having a depth and an opening, with said opening being formed in said top surface and defining an entrance for receiving said plurality of flat graphic articles into said cavity, and said plurality of flat graphic articles being stacked in said cavity.

2. The combination according to claim 1, wherein said tray further comprises another cavity having a depth and an opening formed in said top surface that defines an entrance for receiving a stack of flat graphic articles therein, and said tray has at least two cavities that intersect each other at one or more locations.

3. The combination according to claim 2, wherein said at least two cavities are at least two channels, with each channel having at least two legs, with said legs being connected together at a common end, and at least one leg of one of said channels intersecting at least one leg of another of said channels.

4. The combination according to claim 1, wherein said at least two legs comprises a first leg that is generally straight along its length and a second leg that is generally curved along it length.

5. The combination according to claim 1, wherein said legs come together at a common end such that said legs form an angle of about 90° or less therebetween.

6. The combination according to claim 3, wherein at least one leg of one of said channels passes through and extends beyond at least one leg of another of said channels.

7. The combination according to claim 3, wherein at least one leg of one of said channels intersects two legs of another of said channels.

8. The combination according to claim 7, wherein at least one leg of each of said channels intersects two legs of another of said channels.

9. The combination according to claim 3, wherein said at least two channels is at least three channels and each of said two legs of one of said channels intersects at least one leg from each of two other of said channels.

10. The combination according to claim 9, wherein each of said two legs of two of said channels intersects at least one leg from each of two other of said channels.

11. The combination according to claim 1, wherein said channel includes opposing side walls, with a side wall that has at least one recessed portion that defines an access space, and said access space being positioned along said side wall and dimensioned to facilitate the positioning of a flat graphic article in and out of said channel.

12. The combination according to claim 1, wherein said top surface has a peripheral edge that includes at least one portion that define a hand hold that is positioned and sized to facilitate the positioning of the tray in and out of a container.

13. The combination according to claim 3, wherein each of said channel includes two opposing side walls, at least one channel includes a plurality of vertical positioning ribs at spaced locations along the length of said channel on at least one of said side walls.

14. The combination according to claim 1, wherein said flat graphic articles are paint film articles for replacing conventional liquid paint-on selected portions of a vehicle.

15. The combination according to claim 1 in combination with a plurality of other such trays stacked one on top of the other.

16. A method of using a tray to transport a plurality of at least two different flat graphic articles, said method comprising:

providing at least two trays, each tray comprising a top surface, and at least two cavities that intersect each other at one or more locations, each cavity having a depth and an opening formed in the top surface that defines an entrance for receiving, through the opening, a plurality of a flat graphic article;

depositing flat graphic articles into one of the cavities of one tray;

depositing different flat graphic articles in a different one of the cavities of another tray;

transporting the trays to a location were the flat graphic articles are to be used;

removing and using the flat graphic articles from the one tray;

removing and using the different flat graphic articles from the other tray; and returning the trays in an at least partially empty state for subsequent reuse.

17. The method according to claim 16, further comprising:

sealing the opening of at least one cavity containing flat graphic articles.

18. The method according to claim 16, further comprising:

packaging the trays into a shipping container.

19. The method according to claim 16, wherein said removing and using of tho flat graphic articles and said removing and using of the different flat graphic articles generally occur simultaneously.

20. The method according to claim 16, wherein said removing and using of the flat graphic articles and said removing and using or the different flat graphic articles generally occur consecutively.

21. The method according to claim 16, further comprising:

re-depositing flat graphic articles into one of the cavities of the one tray.

22. The method according to claim 21, further comprising:

re-depositing different flat graphic articles in a different one of the cavities of the other tray.

23. A method of using a tray to transport flat graphic articles, said method comprising:

providing a tray comprising a top surface, and a cavity in the form of a channel longer than it is wide, said channel having at least two legs, with said legs being connected together at a common end, said cavity having a depth and an opening, with the opening being formed in the top surface and defining an entrance for receiving therein, through the opening, a plurality of a flat graphic article; and depositing a stack of flat graphic articles into the cavity.

24. The method according to claim 23 further comprising:

transporting the tray to a location were the flat graphic articles are to be used.

25. The method according to claim 24 further comprising:

removing and using flat graphic articles from the tray.

26. The method according to claim 25 further comprising:

returning the tray in an at least partially empty state for subsequent reuse.

27. A combination comprising a tray and a plurality of paint film articles used to replace conventional liquid paint on selected portions of a vehicle, said tray comprising:

a top surface; and at least two cavities that intersect each other at one or more locations, each cavity being in the form of a channel longer than it is wide, said channel having at least two legs, with said legs being connected together at a common end, each said cavity having a depth and an opening, said opening being formed in said top surface and defining an entrance to said cavity for receiving therein, through said opening, a stack of said paint film articles, wherein each cavity is dimensioned to receive therein said paint film articles.

28. The combination according to claim 27, wherein each of said paint film articles is dimensioned so as to replace conventional liquid paint on the pillar and sash portions of a door window frame.

* * * * *

UNITED STATES PATENT AND TRADEMARK OFFICE

CERTIFICATE OF CORRECTION

PATENT NO. : 6,920,978 B2
DATED : July 26, 2005
INVENTOR(S) : Fischer, Virginia K.

It is certified that error appears in the above-identified patent and that said Letters Patent is hereby corrected as shown below:

Column 9,
Line 7, delete “define” and insert -- defines --, therefor.
Line 11, delete “channel” and insert -- channels --, therefor.
Line 35, delete “were” and insert -- where --, therefor.
Line 52, delete “tho” and insert -- the --, therefor.

Column 10,
Line 3, delete “or” and insert -- of --, therefor.
Line 26, delete “were” and insert -- where --, therefor.

Signed and Sealed this

Twenty-seventh Day of September, 2005

JON W. DUDAS
*Director of the United States Patent and Trademark Office*